US006244341B1

(12) United States Patent
Miller

(10) Patent No.: US 6,244,341 B1
(45) Date of Patent: Jun. 12, 2001

(54) HUFF AND PUFF PROCESS UTILIZING NITROGEN GAS

(75) Inventor: Bernard J. Miller, Lexington, KY (US)

(73) Assignee: Nitrogen Oil Recovery Systems LLC, Lexington, KY (US)

( * ) Notice: Subject to any disclaimer, the term of this patent is extended or adjusted under 35 U.S.C. 154(b) by 0 days.

(21) Appl. No.: 09/358,174

(22) Filed: Jul. 20, 1999

Related U.S. Application Data

(60) Provisional application No. 60/138,441, filed on Jun. 10, 1999.

(51) Int. Cl.[7] ..... E21B 43/00

(52) U.S. Cl. ..... 166/263; 166/279; 166/305.1

(58) Field of Search ..... 166/263, 279, 166/305.1, 369

(56) References Cited

U.S. PATENT DOCUMENTS

| | | | | |
|---|---|---|---|---|
| 3,251,411 | | 5/1966 | Holm . | |
| 3,493,049 | | 2/1970 | Matthews et al. | 166/263 |
| 3,674,092 | | 7/1972 | Bandyopadhyay | 166/271 |
| 3,809,159 | | 5/1974 | Young et al. | 166/258 |
| 3,938,590 | | 2/1976 | Redford et al. . | |
| 3,978,925 | | 9/1976 | Redford | 166/261 |
| 4,008,764 | | 2/1977 | Allen | 166/266 |
| 4,250,965 | | 2/1981 | Wiseman, Jr. . | |
| 4,327,805 | | 5/1982 | Poston | 166/272 |
| 4,330,038 | * | 5/1982 | Soukup et al. | 166/267 |
| 4,390,068 | | 6/1983 | Patton et al. | 166/267 |
| 4,393,936 | | 7/1983 | Josendal | 166/263 |
| 4,398,602 | | 8/1983 | Anderson | 166/245 |
| 4,418,753 | | 12/1983 | Morel et al. . | |
| 4,488,598 | | 12/1984 | Duerksen . | |
| 4,488,600 | | 12/1984 | Fan et al. | 166/263 |
| 4,544,206 | | 10/1985 | Wier et al. . | |
| 4,733,724 | * | 3/1988 | Cardenas et al. . | |
| 4,844,169 | | 7/1989 | Sloat | 166/292 |
| 5,515,919 | | 5/1996 | Stevens et al. . | |
| 5,634,520 | | 6/1997 | Stevens et al. | 166/402 |
| 5,725,054 | | 3/1998 | Shayegi et al. | 166/263 |

OTHER PUBLICATIONS

SPE/DOE 20269 to H.R. Johnson, L.D. Schmidt, and L.D. Thrash, consultants to ICF Resources entitled "A Flue Gas Huff 'n' Puff Process for Oil Recovery From Shallow Formations", copyrighted in 1990.

(List continued on next page.)

*Primary Examiner*—Roger Schoeppel
(74) *Attorney, Agent, or Firm*—Waddey & Patterson; Lucian Wayne Beavers

(57) ABSTRACT

A cyclic or "huff and puff" enhanced oil recovery process utilizes purified nitrogen gas as the injection gas. The purified nitrogen gas is preferably generated near the well site by the use of a membrane separator. The resulting purified nitrogen gas comprises at least about 90% by volume nitrogen with the remaining gas mixture fraction being primarily oxygen. The producing well is shut in. The gas mixture is injected down through the well into the formation. The well is then shut in allowing the gas mixture to soak into the formation for a predetermined period of time of at least 7 days and in some cases as much as 180 days or more. Then the well is placed on production and additional hydrocarbons are produced back from the same well into which the nitrogen gas was injected.

15 Claims, 2 Drawing Sheets

OTHER PUBLICATIONS

SPE 24313 to Brian Evison, Niject Services, and R.E. Gilchrist, Ralph E. Gilchrist Inc. entitled "New Developments in Nitrogen in the Oil Industry" coypyrighted in 1992.
SPE 35319 to J. A. Arévalo—V. and F. Samaniego—V., Pemex and UNAM; F.F. López—C. and E. Urquieta—S., IMP entitled "On the Exploitation Conditions of the Akal Reservoir Considering Gas Cap Nitrogen Injection" copyrighted in 1996.
SPE 36687 to Sara Shayegi, SPE, Louisiana State University, Zhengguo Jin, University of Texas—Arlington, Philip Schenewerk, SPE, University of Missouri—Rolla, and Joanne Wolcott, SPE, Louisiana State University entitled "Improved Cyclic Stimulation Using Gas Mixtures" copyrighted in 1996.
SPE 37556 to Delshad, Mohammad, Nedrud, Michael C. entitled "Residual Oil Saturation in a Pure gravity Drainage Regime" copyrighted in 1997.
SPE 39659 to B. Lepski, University of Alberta, Z. Bassiouni, Louisiana State University, J.M. Wolcott, FAI Solutions entitled "Screening of Oil Reservoirs for Gravity Assisted Gas Injection" copyrighted in 1998.
SPE 49169 to Bernard J. Miller/Bretagne G.P.; Terence Hamilton–Smith/Applied Earth Science entitled "Field Case: Cyclic Gas Recovery for Light Oil–Using Carbon Dioxide/Nitrogen/Natural Gas" copyrighted in 1998. (Not Admitted to be Prior Art).

Shayegi, "Evaluation of Alternative Gases for Immiscible Cyclic Injection", a doctoral dissertation presented to the Department of Petroleum Engineering, Louisiana State University, 1997.

Miller, SPE/DOE 20268, Design and Results of a Shallow, Light Oilfield–Wide Application of $CO_2$ Huff 'n' Puff Process, 1990.

Evison, et al., "Nitrogen–Versitile Gas For the Oil Industry", Petroleum Engineer International, Mar. 1992.

DOE/MC/08333–2 Final Report, "State of the Art Review of Nitrogen and Flue Gas Flooding in enhanced Oil Recovery", Dec. 1980.

Brochure entitled Small NRU Projects are Effective Income Producers (Undated, but admitted to be prior art).

Brochure entitled "Ni—Your Strategic Partner for Enhanced Recovery and Gas Processing" (1998).

SPE11902, "Analysis of Nitrogen Injection Projects to Develop Screening Guides and Offshore Design Criteria", Clancy, et al. (1983).

Brochure entitled "FLOXAL M1000 Series Nitrogen Membrane Systems by Air Liquide" (1996).

* cited by examiner

HUFF AND PUFF PROCESS UTILIZING NITROGEN GAS

This is a Patent Application filed by Bernard J. Miller, a citizen of the United States residing in Lexington, Ky. 40515, in an invention entitled "Huff and Puff Process Utilizing Nitrogen Gas."

This application is a continuation-in-part of and claims benefit of my co-pending provisional patent application Ser. No. 60/138,441 filed Jun. 10, 1999.

BACKGROUND OF THE INVENTION

1. Field of the Invention

The present invention relates generally to enhanced oil recovery processes, and more particularly to a huff and puff process utilizing an injected gas mixture comprising at least about 90% nitrogen by volume.

2. Description of the Prior Art

It has long been known in the oil field that in some instances the recovery of petroleum from an underground formation can be enhanced by a procedure referred to as "cyclic gas recovery" or "huff and puff".

In a cyclic gas recovery process, a chosen gas is injected into a well, allowed to soak into the formation and subsequently the gas along with the desired hydrocarbons and other fluids are produced back out of the same well into which the injection gas was injected. Thus, the name "huff and puff".

Many different gases have been utilized as the injection gas in a huff and puff process.

The general engineering theory of the performance of the huff and puff procedure, a history of its development, and a description of the various gases and gas mixtures which have been utilized is found in U.S. Pat. No. 5,725,054 to Shayegi et al. That same work is further described in paper no. SPE 36687, presented to the Society of Petroleum Engineers, Inc. in 1996, entitled "Improved Cyclic Stimulation Using Gas Mixtures", and also in the doctoral dissertation of Sara Shayegi entitled "A VALUATION OF ALTERNATIVE GASES FOR IMMISCIBLE CYCLIC INJECTION" submitted to the Louisiana State University, Department of Petroleum Engineering, in December 1997. The Shayegi references are incorporated herein by reference.

As is apparent from the summary set forth in the Shayegi references, there is a continuing search for improved injection gases to be utilized in huff and puff processes. The most commonly used gases have been steam, carbon dioxide, natural gas and exhaust gas. Previously, pure nitrogen gas has not been utilized in huff and puff procedures. The extensive literature survey conducted by Shayegi et al. as recorded in U.S. Pat. No. 5,725,054, reported at Column 3, Lines 3–4 that "no studies regarding the use of pure nitrogen for cyclic injection have been found in the literature". The laboratory tests reported by Shayegi et al. compared the use of pure carbon dioxide, pure methane and pure nitrogen, and concluded that nitrogen recovered only about one-half as much additional oil as either pure carbon dioxide or pure methane. See Shayegi et al., SPE 36687, "Improved Cyclic Stimulation Using Gas Mixtures", at Page 2.

Relatively pure nitrogen gas has been utilized in the prior art for well to well injection processes, as contrasted to huff and puff procedures. Nitrogen has been utilized in oil recovery as a dry gas or attic recovery gas in a displacement process, whereby, the nitrogen is injected into an injection well and oil is displaced to a different production well. Although there is not complete agreement by those skilled in the art as to the physical processes which are occurring in these well stimulation procedures, it is generally understood that the physical phenomena occurring during a well to well gas injection stimulation process are different from those occurring in a huff and puff process.

Additionally, the prior art has recently seen the development of improved apparatus for producing relatively pure nitrogen gas. These developments are summarized in Evison, et al. SPE 24313, entitled "New Developments in Nitrogen in the Oil Industry", 1992, Society of Petroleum Engineers, Inc. One particular new apparatus for providing purified nitrogen gas is an air separating system utilizing polymeric membranes which separate the nitrogen from the air. The description of various systems for providing purified nitrogen gases as set forth in Evison, et al. is incorporated herein by reference.

Thus, it is seen that there is a continuing need in the oil industry for further improved enhanced oil recovery processes.

SUMMARY OF THE INVENTION

The present invention provides an enhanced oil recovery method for producing additional petroleum from existing production wells which penetrate an underground formation. The producing well is shut in. Then a gas mixture containing at least about 90% nitrogen by volume is generated, preferably by separating the gas mixture from air using a membrane separator. The gas mixture is injected down through the well into the formation. The well is then shut in allowing the gas mixture to soak into the formation for a predetermined period of time of at least 7 days and in some cases as much as 180 days or more. Then the well is opened up and additional hydrocarbons are produced back from the same well into which the nitrogen gas was injected.

It is therefore, a general object of the present invention to provide improved enhanced oil recovery methods.

Another object of the present invention is the provision of a huff and puff stimulation procedure utilizing purified nitrogen gas.

Still another object of the present invention is the provision of economical well stimulation well procedures utilizing on-site generated nitrogen gas provided by a membrane separator.

Other and further objects, features and advantages of the present invention will be readily apparent to those skilled in the art upon a reading of the following disclosure when taken in conjunction with the accompanying drawings.

BRIEF DESCRIPTION OF THE DRAWINGS

In FIG. 2 the nitrogen gas is being injected into the well.

DETAILED DESCRIPTION OF THE PREFERRED EMBODIMENTS

Figure 1:
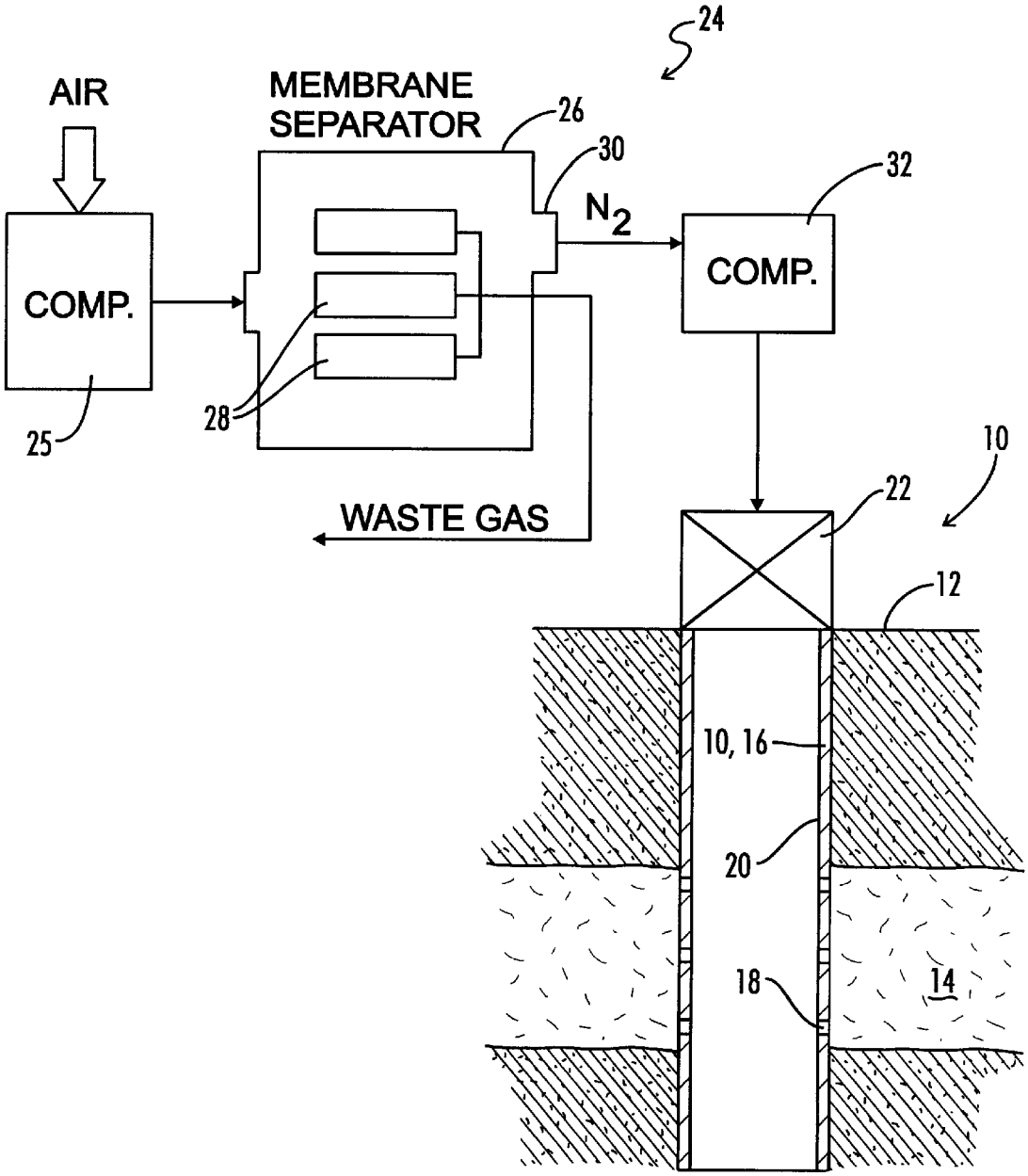
FIG. 1 is a schematic illustration of an on-site membrane separator for producing nitrogen gas, and the injection of that gas into a well.

Referring now to the drawings, and particularly to FIG. 1, a well 10 is shown extending downward from the earth's surface 12 and penetrating a subterranean formation 14 from which petroleum and other hydrocarbon products are to be produced. The well 10 includes a well casing 16 having perforations 18 which permit communication of the well bore 20 with the subterranean formation 14. A well head 22 located above the earth's surface controls the flow of fluids into and out of the well in a conventional manner for a flowing or artificial lift well.

A separator system 24 is schematically illustrated. It is noted that the separator system 24 may be located immediately adjacent the well or it may be located somewhere else in the oil field. A given field may have many wells which simultaneously receive injection gas from a single membrane separator unit which may be located several miles from some of the wells.

System 24 may, for example, be a "FLOXAL"® M1000 Series Nitrogen Membrane System available from Air Liquide. The separator system 24 includes a first compressor 25 which compresses air and directs it to a membrane separator assembly 26. The membrane separator assembly 26 typically has a plurality of hollow tubular cartridges 28 made of a fibrous material which has a thin outer coating of a selected polymeric material which actually forms the membrane. The material is selected such that oxygen and other associated waste materials may permeate through the membrane and thus be discharged through a waste gas line 29. The remaining gas exiting at 30 from the membrane separator is a relatively high purity relatively dry nitrogen gas.

The nitrogen gas exiting at 30 from the membrane separator assembly 26 typically has a purity of at least 90% by volume nitrogen. The remaining 10% or less of the mixture is primarily oxygen with minute traces of other atmospheric gases present. Thus, the gases discharged at exit 30 may be described as a gas mixture comprising at least about 90% nitrogen by volume with the remaining gas mixture fraction being primarily oxygen.

A booster compressor 32 may be utilized to achieve the desired injection gas pressure to the well head 22, or if the nitrogen gas exits the separator assembly 26 at a suitable pressure, it may be directed straight to the well head 22.

The membrane separator operates on the principle that oxygen will permeate through the polymeric membrane more readily then will nitrogen, because of the higher solubility and diffusivity of the oxygen. Thus, when the compressed air is presented to the membrane, oxygen will pass through the membrane and nitrogen will stay on the upstream side of the membrane. Since the nitrogen does not have to pass through the membrane, it will be discharged at the outlet 30 at close to the discharge pressure of the first compressor 25. Thus, relatively pure high pressure nitrogen gas is created with a very simple procedure.

If desired, additional stages of membrane separation can be provided wherein the purified nitrogen resulting from the first separation stage can be directed to a second separator for further purification. With staged separation, purities as high as 99% nitrogen by volume may be accomplished.

Other major atmospheric impurities, such as water and carbon dioxide, have relatively high permeabilities, so that most of those materials will pass through the membrane with the oxygen so that nearly all of the atmospheric contaminates will be discharged as waste from the membrane separator system.

Typical membrane separator systems 24 presently available can provide nitrogen at a rate of from 2,000 cubic feet per hour to 40,000 cubic feet per hour.

Membrane separator systems such as the "FLOXAL"® m1000 Series noted above are typically designed to produce nitrogen gas having a purity of 95% or greater. The presence of oxygen is not believed to be a positive factor for the injection process, and thus, if there were no other considerations, it would be preferable to have the highest possible nitrogen concentration of 99% or greater.

The presence of excessive oxygen is believed to cause several undesirable effects:

1) it can react with other materials present in the formation and drop out as a solid which will plug the formation;

2) the presence of oxygen causes corrosion of equipment; and 3) oxygen can cause fire or explosion in the reservoir.

When using the membrane separator to generate nitrogen there are countervailing factors, however. For a given membrane separator machine, it can only produce a given purity of gas, e.g. 95%, at a specified design rate. That same machine, however, can generate gas having a lower nitrogen concentration, e.g. 90% or 92.5%, at a higher production rate. Thus, a larger volume of gas can be provided for injection into the well if the required nitrogen concentration is reduced. Higher volume of injected gas will result in higher oil production.

Thus, for a given oil field and given equipment set-up, there will be an optimum nitrogen gas concentration. The concentration will be low enough to allow economical production of large volumes of gas for injection. The concentration will be high enough that there will not be sufficient oxygen present to lead to the various undesirable effects noted above.

I believe that the lowest nitrogen concentration which should be used is about 90%. Anything lower will contain so much oxygen that unacceptable deleterious effects of the oxygen will occur. That example described below, which is still in progress, has been conducted using 95% nitrogen for a first portion of the test, and 92.5% nitrogen for a second portion of the test. So far, both appear to have produced comparable and acceptable results.

In general, the methods of the present invention should utilize an injection gas comprising at least 90% nitrogen gas by volume, with the remaining 10% being primarily oxygen. Even more preferably, the gas mixture should comprise at least about 95% nitrogen by volume. These volumetric percentages are measured at the outlet 30 of the membrane separator 24. Gas conditions at the outlet are typically 100° F. at a pressure in the range of 140 to 150 psig.

I have discovered that, contrary to the predictions of prior work, such as that of Shayegi et al., the use of relatively pure nitrogen gas, such as that produced from an on-site membrane separator system, provides superior results in a huff and puff enhanced oil recovery process, when the injected nitrogen is allowed to soak into the formation for a sufficient time.

The process is typically performed as follows. Although the process may be applied to a newly completed well, typically a huff and puff procedure is performed on an existing production well in which the natural production capabilities of the well have diminished to a low level.

The producing well is then shut in, that is, it is closed so that formation fluids stop producing from the well. Then a nitrogen gas generating system such as that just described, is provided near the well site and used to generate a gas mixture containing at least 90% nitrogen by volume by the separation of that gas mixture from air using a membrane separator.

Figure 2:
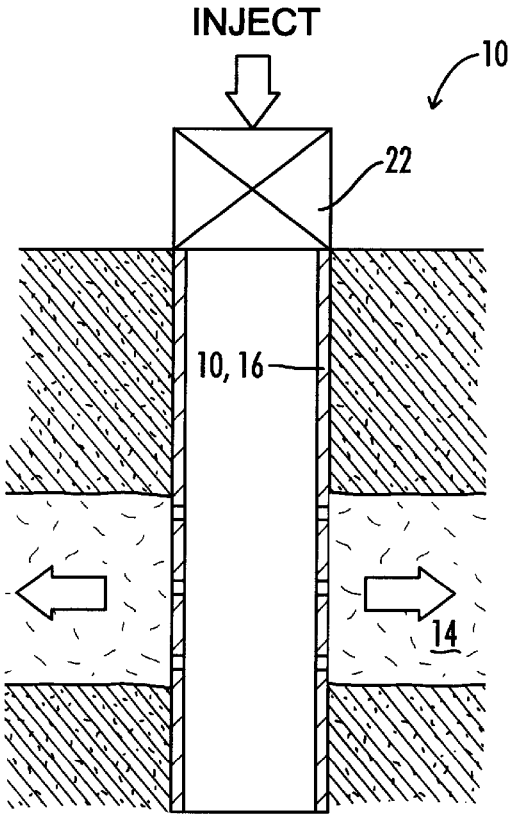
FIG. 2 is the first of a series of sequential schematic illustrations of the huff and puff process.

Then the primarily nitrogen gas mixture is injected down through the well and into the formation 14 as schematically illustrated in FIG. 2. The nitrogen gas is injected into the well at sufficient pressure to overcome the reservoir pressure and to overcome friction losses as the gas flows down into the well. The injection pressure should, however, be maintained below the fracture pressure of the reservoir. It is not desired to fracture the reservoir by this injection process. The ultimate rate of injection will be determined by the availability of nitrogen supply and equipment design, and by the need to keep the injection pressure below fracture pressure.

The volume of nitrogen gas to be injected into the well will be dependent upon the oil well reservoir parameters such as thickness, porosity, permeability, and saturation of oil, water and gas.

Figure 3:
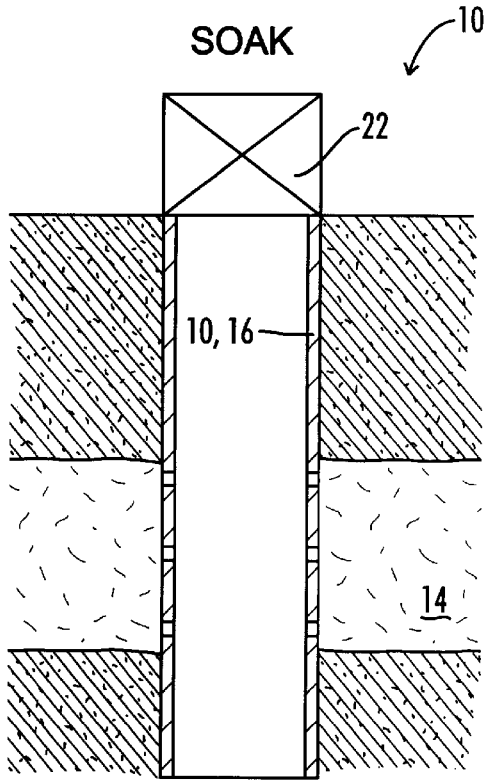
FIG. 3 is a view similar to FIG. 2 representing the soak period during which the nitrogen gas soaks into the formation.

After the nitrogen gas is injected, the well will be shut in to allow the nitrogen gas to soak into the formation 14 as schematically represented in FIG. 3. The desired soak period will also be varied dependent upon the parameters of the formation, but I have found that for nitrogen gas huff and puff procedures, the soak period should be at least 7 days. In some cases, the soak period is preferably maintained for at least 30 days. In other cases, it may be desirable to maintain the soak period for 180 days or more.

For any given producing field, the optimum soak period will be determined by analysis of the formation parameters, and to some extent on a trial and error basis.

Figure 4:
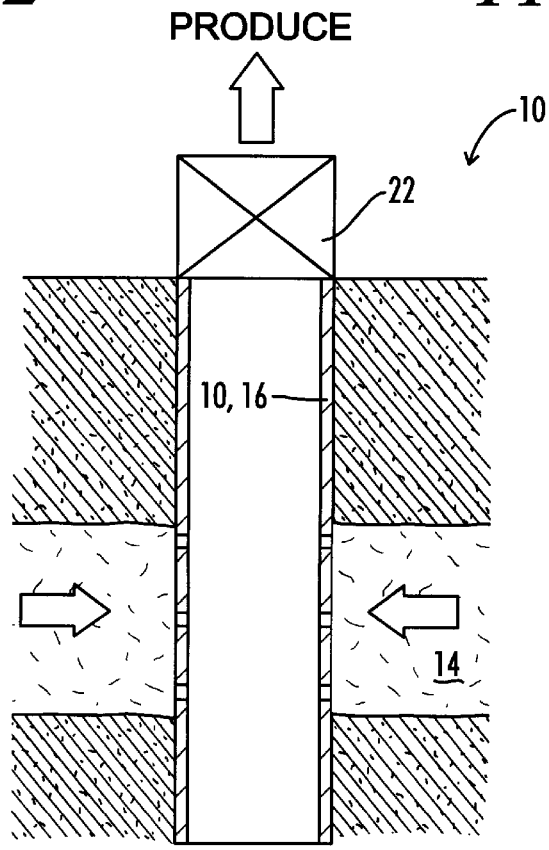
FIG. 4 is a view similar to FIG. 2 schematically illustrating the subsequent production period wherein oil, water and gas are produced from the formation back up through the same well into which the gas was injected.

After the desired soak period, the well is again placed back on production to allow formation fluids, including oil, gas and water, to be produced out of the well as schematically represented in FIG. 4. A successful nitrogen gas huff and puff stimulation procedure will result in significantly increased oil production from the well as compared to the production which was occurring prior to the procedure.

After the well has been produced for a period of time, the well production will again taper off, and the huff and puff stimulation procedure may be repeated. The process may be repeated so long as the resulting enhanced oil recovery economically justifies the cost of the procedure.

It should be noted that the nitrogen gas injection huff and puff process is an immiscible gas recovery process. Pressure in the reservoir will always be below miscible conditions. Operating pressures will be below 0.7 psi per foot of depth from the surface to the formation.

Field tests of the nitrogen gas huff and puff procedure of the present invention have shown the success of the process, as is shown in the following example.

EXAMPLE

Field Test

Big Andy Ridge Immiscible Cyclic Nitrogen Oil Recovery Project

Appalachian Basin, Lee and Wolfe Co. Kentucky, USA

1. Summary:

The big Andy Ridge Project involves immiscible nonhydrocarbon gas displacement; whereby, oil is displaced from the reservoir rock by means of modifying the properties of the fluids in the reservoir. The primary processes are: a. reduction of relative permeability to gas after soaking and b. a reduction in water relative permeability in the presence of nitrogen.

Nitrogen gas injection was initiated on day 1. As of day 339, the total cum injection of nitrogen is 109 million standard cubic feet and the total incremental recovery from the project is 30,000 bbls. Production has increased 200 BOPD from the projected production rates. The source of nitrogen is an onsite nitrogen membrane unit.

During the first eight months of the test, the injected gas was 95% $N_2$ and 5% $O_2$. During the last several months of the test, the injected gas was 92.5% $N_2$ and 7.5% $O_2$. Preliminary indications are that the lower $N_2$ concentration works about the same as the higher concentration.

Project Process

The nitrogen cyclic process contains three phases

1. Injection Phase. The gas is injected directly into the producing well. A gas volume of approximately 1,000 MCF (10% of the total pore space of the well drainage area of five acres) is injected. The well pressure is increased from 15 psia to 150 psia.
2. Soak Phase. After the injection, the well is closed in and the nitrogen is allowed to dissipate into the pore space of the reservoir. In this project, the soak period has been 30 days.
3. Production Phase. The well is placed back on production and the oil production response is immediate with the well production increasing ten fold. The production phase increase is indicated to be two to three years.

Project Design

The 400 wells in the project are expected to respond favorably to at least 3 cycles of nitrogen injection. With 1,000 MCF used per cycle and 400 wells, the total demand is 1,200,000 MSCF. The requirement will be filled by the use of one membrane unit the first 11 months at a capacity of 360 MCFD followed by a plant expansion to 1,000 MCFD. Gas injection was started Jul. 27, 1998 and the plant was expanded to 1,000 MCFD in June 1999. The optimum time between cycles shows to be one year; thus, the injection phase will be over a four year period (July 1998 thru July 2002).

The recovery efficiency is projected to be a composite 2 MCF/BBL (for each two MCF of nitrogen injected one tertiary bbl will result). Thus, the cumulative tertiary recovery of 600,000 BBLS (1500 BBLS per well) is projected. The peak incremental tertiary production is projected at 450 BOPD. This recovery will result in an additional recovery of 2% of the oil in place.

It is noted that the example described above is still in progress. The preliminary results, however, show increased production comparable to that which had previously been obtained in this same field with $CO_2$ huff and puff injection. This is both very surprising and very significant. The field on which the test is being conducted is one which has previously been found to respond very favorably to $CO_2$ injection. I have previously described this $CO_2$ injection work in SPE/DOE 20268, "Design and Results of a Shallow, Light Oilfield-Wide Application Of $CO_2$ Huff 'n' Puff Process" (1990).

It was generally believed in the art, however, that nitrogen gas injection would not achieve the same results. See, for example, the Shayegi, et al. studies cited above. At least one reason for that prior belief was that $CO_2$ acts on the formation by two physical mechanisms which are not provided by nitrogen gas. The $CO_2$ is believed to stimulate oil production by: 1) dissolving in the oil and thereby lowering the viscosity of the oil; and 2) swelling the oil. Nitrogen does not cause either of these phenomena, and thus, was not expected to produce comparable results. Surprisingly, however, the results I have observed so far with nitrogen injection are just as favorable as those previously observed with $CO_2$ injection.

This is very significant because nitrogen is much less expensive than $CO_2$.

Although no one can know for certain what the physical phenomena are that are occurring during my nitrogen gas huff and puff procedure, I believe that one or more of the following phenomena may be responsible.

The field tests described above have shown that the injected nitrogen gas is not functioning simply as a displacement fluid which would in fact drive surrounding fluids away from the injection well.

It is believed that oil recovery from the nitrogen gas huff and puff process is probably a combination of the following:

1. attic oil recovery from gravity segregation and gravity override;
2. introduction of the nitrogen gas into the formation may alter the relative permeability of the flow of formation oil, gas and water;
3. gas hysterisis effect causing nitrogen gas to be trapped and resulting in displacement of oil; and
4. gas bubbles formed during the cyclic pressuring and depressuring may occur in the formation water and result in the decrease of the ability of the water to flow relative to the oil, thus resulting in an increased flow of oil from the formation.

For the particular example set forth above, I believe that the primary factors contributing to the increase oil production are:

a.: Reduction of relative permeability to gas after soaking; and b.: The reduction of relative permeability to water in the presence of gas.

Thus the favorable characteristics of formations to which my nitrogen huff and puff procedure may be most applicable are:

a. Natural fractures in the reservoir rock with induced fractures;

b. Mobil free gas saturation;

c. Mobil water saturation;

d. Low pressure—less than 20% of initial; and e. Light oil.

Unfavorable characteristics would be:

a. Oil reservoir overlain by large gas cap; and b. No free gas in the oil reservoir.

Thus, it is seen that the methods of present invention readily achieve the ends and advantages mentioned as well as those inherent therein. While certain preferred embodiments of the invention have been illustrated and described for purposes of the present disclosure, numerous changes in the arrangement of steps may be made by those skilled in the art, which changes are encompassed within the scope and spirit of the present invention as defined by the appended claims.

What is claimed is:

1. A method of recovering petroleum from an underground reservoir penetrated by a well, the method comprising the steps of:

(a) injecting down the well and into the formation a gas mixture comprising at least about 90% nitrogen by volume, and the remaining non-nitrogen portion of the gas mixture being primarily oxygen;

(b) after step (a), shutting in the well and allowing the gas mixture to soak into the formation for a pre-determined period of time; and (c) after step (b), producing the petroleum from the same well into which the gas mixture was injected in step (a).

2. The method of claim 1, wherein:

in step (b) the pre-determined period is at least seven days.

3. The method of claim 1, wherein:

in step (b) the pre-determined period is at least thirty days.

4. The method of claim 1, wherein:

in step (b) the pre-determined period is at least one hundred and eighty days.

5. The method of claim 1, further comprising: prior to step (a), generating the gas mixture by separating nitrogen from air with a membrane.

6. The method of claim 1, wherein:

in step (a), the gas mixture is injected at a pressure sufficient to overcome reservoir pressure and friction losses, and below a pressure which would fracture the reservoir.

7. The method of claim 1, further comprising:

after producing petroleum from the well in step (c) for a period of time, shutting in the well and repeating steps (a), (b) and (c).

8. The method of claim 1, wherein:

in step (a) the gas mixture comprises at least about 95% nitrogen by volume.

9. The method of claim 1, further comprising:

prior to step (a), generating the gas mixture by separating nitrogen from air.

10. An enhanced oil recovery method for producing additional petroleum from an existing producing well penetrating an underground formation, comprising:

(a) shutting in the producing well;

(b) generating a gas mixture containing at least 90% nitrogen by volume by separating the gas mixture from air using a membrane;

(c) injecting the gas mixture into the well and thus into the formation;

(d) allowing the gas mixture to soak into the formation for a soak period of at least seven days; and (e) opening the well and producing additional petroleum from the formation.

11. The method of claim 10 wherein in step (d), the soak period is at least one hundred eighty days.

12. The method of claim 10 wherein:

in step (c) the gas mixture is injected at a pressure below fracturing pressure of the formation.

13. The method of claim 10 wherein:

step (e) includes producing the well until petroleum production falls off to an unacceptable level; then shutting in the well and repeating steps (c), (d) and (e).

14. The method of claim 10 wherein:

in step (b), the gas mixture contains at least 95% nitrogen by volume.

15. The method of claim 10 wherein in step (d), the soak period is at least thirty days.

* * * * *